US006133516A

United States Patent [19]

Hendrickson

[11] Patent Number: 6,133,516

[45] Date of Patent: Oct. 17, 2000

[54] INSTRUMENT PICK WITH MULTIPLE PICK MEMBERS

[75] Inventor: Robert Hendrickson, Claremont, Calif.

[73] Assignee: California Acrylic Industries, Inc., Pomona, Calif.

[21] Appl. No.: 09/200,516

[22] Filed: Nov. 25, 1998

[51] Int. Cl.[7] ..... G10D 3/16

[52] U.S. Cl. ..... 84/322

[58] Field of Search ..... 84/320–322

[56] References Cited

U.S. PATENT DOCUMENTS

| | | | |
|---|---|---|---|
| 2,484,820 | 10/1949 | Galetzky . | |
| 3,678,793 | 7/1972 | Schutze | 84/322 X |
| 4,248,128 | 2/1981 | Gaines | 84/322 |
| 4,651,614 | 3/1987 | Cavallo | 84/322 |
| 4,790,227 | 12/1988 | Lukehart | 84/322 |
| 5,261,307 | 11/1993 | Domanski | 84/322 |
| 5,594,189 | 1/1997 | Latteri | 84/322 |
| 5,942,704 | 8/1999 | Weldon | 84/320 |

*Primary Examiner*—Jeffrey Donels
*Attorney, Agent, or Firm*—Sheldon & Mak; Denton L. Anderson

[57] ABSTRACT

An instrument pick is constructed with a finger grip portion and a multiplicity of narrow elongate pick members. Typically, between about 5 and about 30 pick members are used in the instrument pick. The pick members are generally of uniform thickness of between about 0.05 cm and about 0.2 cm. The pick members are generally between about 0.5 cm and about 2.5 cm in length.

14 Claims, 1 Drawing Sheet

INSTRUMENT PICK WITH MULTIPLE PICK MEMBERS

FIELD OF THE INVENTION

This invention relates generally to stringed instruments and, specifically, to picks for strumming stringed instruments.

BACKGROUND OF THE INVENTION

Picks for strumming stringed instruments have been known for thousands of years. A typical instrument pick is a small solid object having a finger grip portion and a pick member portion. The finger grip portion is dimensioned to be comfortably held in the fingers of the instrument player. The pick member portion is a generally tapered extension of the finger grip portion, terminating in a pointed configuration suitable for strumming the individual strings on a stringed instrument.

It is an object of the invention to provide a new kind of instrument pick which provides markedly different tonal qualities over instrument picks of the prior art.

SUMMARY

The invention satisfies this need. The invention is an instrument pick for strumming a stringed instrument comprising (a) a finger grip sized, dimensioned and configured for being held in the fingers of an instrument player; and (b) a plurality of narrow, elongate pick members attached to the finger grip.

The instrument pick can be made in a variety of shapes and from a variety of materials as discussed below. Use of the instrument pick has been found to provide a unique and highly pleasing timbre from guitars and other stringed instruments.

DRAWINGS

These features, aspects and advantages of the present invention will become better understood with regard to the following description, appended claims and accompanying figures where:

Figure 5:
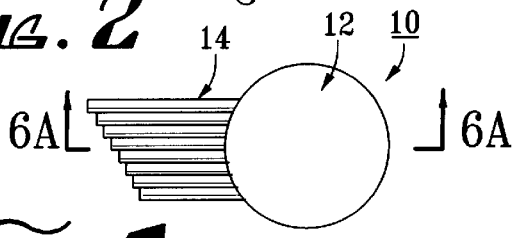
FIG. 5 is a side view of a fourth instrument pick having features of the invention.
Figure 6A:
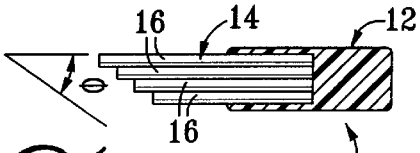
Figure 7:
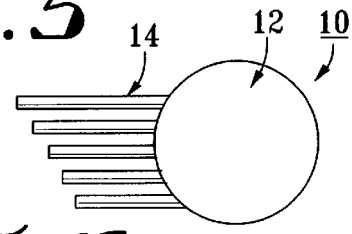
Figure 6B:
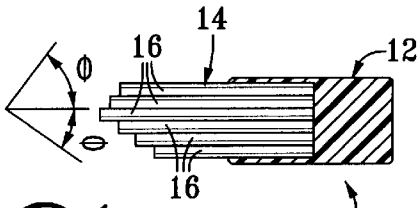
Figure 8:
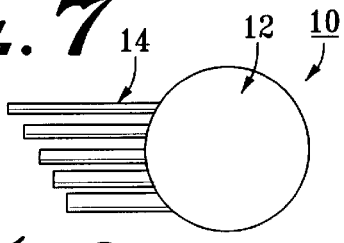
Figure 9:
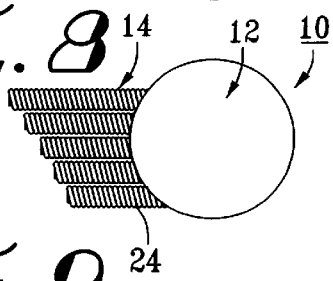
Figure 10:
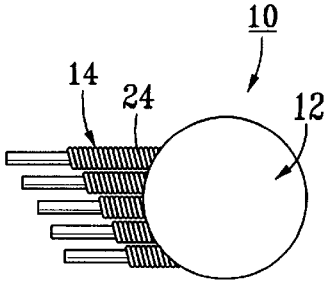

FIG. 6*a* is a first alternative cross-sectional view of the instrument pick illustrated in FIG. 5, taken along line 6—6;

FIG. 6*b* is a second alternative cross-sectional view of the instrument pick illustrated in FIG. 5, taken along line 6—6;

FIG. 7 is a side view of a fifth instrument pick having features of the invention;

FIG. 8 is a side view of a sixth instrument pick having features of the invention;

FIG. 9 is a side view of a seventh instrument pick having features of the invention; and FIG. 10 is a side view of an eighth instrument pick having features of the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an instrument pick 10 suitable for strumming a stringed instrument. The invention can comprise a finger grip 12 and a plurality of pick members 14.

The finger grip 12 is generally sized, dimensioned and configured to be suitable and to be comfortable when held between the thumb and forefinger of a musician playing the stringed instrument. In a typical embodiment, the finger grip 12 is generally planar having opposed front and back sides, each having an area between 3.5 square centimeters and 4.5 square centimeters. The finger grip 12 can be made from a variety of materials, such as metals, woods and plastics. For ease and convenience of manufacture, the finger grip 12 is typically made from a rigid plastic material.

The finger grip 12 can have any number of convenient shapes. In the embodiments illustrated in the drawings, triangular, circular and oval shapes are illustrated. Other shapes can be used as well.

The pick members 14 are attached to the finger grip 12 by any convenient method known in the art. Typically, the pick members 14 are attached to the finger grip 12 by glue or (where the finger grip 12 is a plastic material) by thermal processes. Typically, the pick members 14 are separate pieces which are attached to the finger grip 12. However, instrument picks 10 of the invention can be provided as integral, one-piece units as well.

As few as two pick members 14 can be used in the invention 10. In a typical embodiment, however, the number of pick members 14 is between 5 and 30, most typically between 15 and 25.

Figure 1:
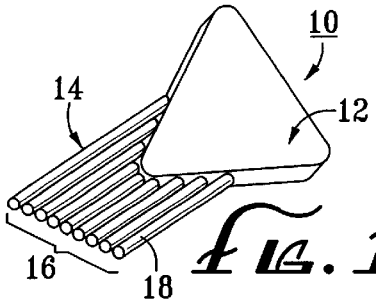
FIG. 1 is a perspective view of a first instrument pick having features of the invention.

Each of the pick members 14 is narrow and elongate, having a ratio of length to average thickness between 2 and 150, preferably between 10 and 100. In a typical embodiment, the pick members 14 are between 0.5 cm and 2.5 cm in length, most typically between 0.5 cm and 2 cm, and are between 0.02 cm and 0.5 cm in thickness, most typically between 0.05 cm and 0.2 cm. Typically, each pick member 14 has a thickness which is uniform along its entire length, but this is not necessary. In a typical embodiment, as illustrated in FIG. 1, each individual pick member 14 is substantially linear as opposed to being planar. By "substantially linear" it is meant that each pick member 14 has a ratio of length to average thickness between 2 and 150. Also, a cross-section of each pick member 14 is typically circular, but other shapes can be used as well.

Each pick member 14 is made from a material having a suitable stiffness to provide musical tones when strummed across the strings of a musical instrument. Typically, the pick members 14 are made from a metal, but other materials, such as nylon and other hard plastics can be used as well. In one embodiment, the pick members 14 are made from portions of instrument strings having diameters similar to one or more of the instrument strings on the instrument to be played. Use of instrument picks 10 having such pick members 14 has been found to provide a particularly interesting tonal quality. This is believed to arise from a "filtering effect," wherein the strumming of the instrument strings by pick members 14 of similar thickness and material amplifies and attenuates sound frequencies in a fashion markedly different from that derived from prior art plastic picks. In many ways, filtering provided by such embodiments of the invention 10 is considerably more pleasant to the ear than similar filtering produced by picks of the prior art. This is surprising, because metallic picks of the prior art are generally held to provide a sound considerably "harsher" than plastic picks of the prior art. The improved filtering effect of these embodiments of the invention 10 allow a relatively inexpensive guitar, for example, to produce music of a surprisingly pleasant quality.

As illustrated in the drawings, the plurality of pick members 14 are typically disposed in parallel with respect to one another. However, this is not essential.

Figure 3:
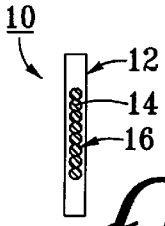
FIG. 3 is a cross-sectional view of the instrument pick illustrated in FIG. 2, taken along line 3—3.
Figure 2:
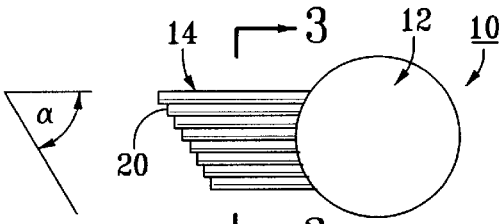
FIG. 2 is a side view of a second instrument pick having features of the invention.

In a typical embodiment, such as illustrated in FIG. 2, the pick members 14 are configured in a singular planar tier 16 disposed in a pick member plane 18, as illustrated in FIG. 3. In the embodiment illustrated in FIG. 2, the distal ends 20 of the pick members 14 are made to terminate along a transverse plane disposed perpendicular to the pick member plane 18. The transverse plane can be disposed at any of a variety of angles $\alpha$ with respect to the pick members 14. Typically, the transverse plane is disposed between 45° and 90° with respect to the pick members 14.

Figure 4:
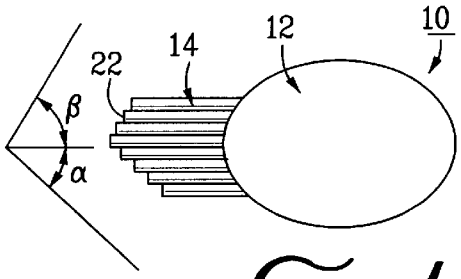
FIG. 4 is a cross-sectional view of a third instrument pick having features of the invention.

In an alternative embodiment illustrated in FIG. 4, the distal ends 16 of the pick members 14 are disposed along one of two transverse planes disposed perpendicular to the pick member plane 18. In this embodiment, the pick member plane 18 terminates at a generally centralized point 22. The angles $\alpha$ and $\beta$ at which the two transverse planes are disposed can be equal to one another or different. Typically, both angles $\alpha$ and $\beta$ are between 45° and 90°.

In the embodiment illustrated in FIGS. 2 and 3, the pick members 14 are disposed in a single planar tier 16. In the embodiments illustrated in FIGS. 5, 6*a* and 6*b*, on the other hand, the pick members 14 are disposed in two or more planar tiers 16. The plurality of the planar tiers 16 can terminate along a transverse plane disposed at any angle $\theta$ between 45° and 90° with respect to the longitudinal axis of the pick members 14, as illustrated in FIG. 6A. FIG. 6*b* illustrates an alternative embodiment wherein the plurality of planar tiers 16 terminates in one of two intersecting planes disposed at similar or differing angles $\theta$ and $\phi$ with respect to the longitudinal axis of the pick members 14, each typically between about 45° and about 90°.

As illustrated in FIGS. 1, 2, 4 and 5, the pick members 14 are disposed in close proximation to one another. However, as illustrated in FIG. 7, the pick members 14 can be disposed relatively spaced-apart from one another, for example, by a distance of between 1 mm and 2 mm.

Typically, the thickness of the individual pick members 14 is uniform among all pick members 14. However, interesting effects can be achieved by using pick members 14 of differing thicknesses, such as illustrated in FIG. 8.

In another embodiment of the invention, as illustrated in FIG. 9, the pick members 14 are made from wound materials, such as portions of wound instrument strings wound with a helical winding 24. Use of such pick members 14 in the invention 10 provides a "zippery" sound quality which is both unique and pleasant.

In a related embodiment, the pick members 14 can be partially wound, such as illustrated in FIG. 10. Such embodiments are capable of providing a number of different "timbres," depending upon how the musician holds the instrument pick 10, and how much pressure he or she applies to the instrument pick 10 while strumming the instrument. Moreover, use of instrument picks 10, such as illustrated in FIG. 10, allow the musician to alternatively produce a "zippery" sound (by using the wound portion of the pick members 14) or a "glassy" sound (by using the non-wound portions of the pick members 14).

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An instrument pick for strumming a stringed instrument comprising:

(a) a finger grip; and (b) a plurality of narrow, elongate, substantially linear pick members attached to the finger grip;

wherein the pick members are disposed in a pick member plane and wherein the pick member plane terminates along a transverse plane disposed at an angle of between 45° and 90° with respect to the pick members.

2. The instrument pick of claim 1 wherein the pick members are disposed in a plurality of planar tiers.

3. An instrument pick for strumming a stringed instrument comprising:

(a) a finger grip; and (b) a plurality of narrow, elongate, substantially linear pick members attached to the finger grip;

wherein the pick members have differing average thicknesses.

4. An instrument pick for strumming a stringed instrument comprising:

(a) a finger grip; and (b) a plurality of narrow, elongate, substantially linear pick members attached to the finger grip;

wherein a portion of each pick member, but not all of each pick member, is wound with a helical winding.

5. An instrument pick for strumming a stringed instrument comprising:

(a) a finger grip; and (b) a plurality of narrow, elongate, substantially linear pick members attached to the finger grip;

wherein the pick members are disposed in a plurality of parallel planar tiers.

6. An instrument for strumming a stringed instrument comprising:

(a) a finger grip; and (b) a plurality of narrow, elongate, and substantially circular pick members attached to the finger grip, each pick member having a length between 0.5 cm and 2.5 cm and having an average thickness of between 0.02 cm and 0.5 cm;

wherein the pick members are constructed from portions of instrument strings.

7. The instrument pick of claim 6 wherein the pick members include at least one pick member which is made from a portion of a wound string.

8. An instrument for strumming a stringed instrument comprising:

(a) a finger grip; and (b) a plurality of narrow, elongate, and substantially circular pick members attached to the finger grip, each pick member having a length between 0.5 cm and 2.5 cm and having an average thickness of between 0.02 cm and 0.5 cm;

wherein the pick members are disposed in a pick member plane and wherein the pick member plane terminates along a transverse plane disposed at an angle of between 45° and 90° with respect to the pick members.

9. An instrument for strumming a stringed instrument comprising:

(a) a finger grip; and (b) a plurality of narrow, elongate, and substantially circular pick members attached to the finger grip, each pick member having a length between 0.5 cm and 2.5 cm and having an average thickness of between 0.02 cm and 0.5 cm;

wherein a portion of each pick member, but not all of each pick member, is wound with a helical winding.

10. An instrument for strumming a stringed instrument comprising:

(a) a finger grip; and (b) a plurality of narrow, elongate, and substantially circular pick members attached to the finger grip, each pick member having a length between 0.5 cm and 2.5 cm and having an average thickness of between 0.02 cm and 0.5 cm;

wherein the pick members are disposed in a plurality of parallel planar tiers.

11. An instrument pick for strumming a stringed instrument comprising:

(a) a finger grip; and (b) a plurality of narrow, elongate, pick members attached to the finger grip, wherein the pick members are constructed from portions of instrument strings.

12. The instrument pick of claim 8 wherein the plurality of instrument strings include at least one instrument string which is made from a portion of a wound string.

13. The instrument pick of claim 8 wherein the pick members have differing average thicknesses.

14. The instrument pick of claim 8 wherein a portion of each pick member, but not all of each pick member, is wound with a helical winding.

* * * * *

UNITED STATES PATENT AND TRADEMARK OFFICE

CERTIFICATE OF CORRECTION

PATENT NO. : 6,133,516
DATED : October 17, 2000
INVENTOR(S) : Robert Hendrickson It is certified that error appears in the above-identified patent and that said Letters Patent is hereby corrected as shown below:

Title page,
Item [73], delete "California Acrylic Industries, Inc., Pomona, Calif."

Signed and Sealed this

Twelfth Day of February, 2002

*Attest:*

*Attesting Officer*

JAMES E. ROGAN
*Director of the United States Patent and Trademark Office*